US006332696B2

(12) United States Patent
Schepens

(10) Patent No.: US 6,332,696 B2
(45) Date of Patent: Dec. 25, 2001

(54) TRAFFIC LIGHT LENS COVER

(76) Inventor: Clyde R. Schepens, 20091 Daugherty Rd., Long Beach, MS (US) 39560

( * ) Notice: Subject to any disclaimer, the term of this patent is extended or adjusted under 35 U.S.C. 154(b) by 0 days.

(21) Appl. No.: 09/850,154

(22) Filed: May 8, 2001

Related U.S. Application Data

(63) Continuation of application No. 09/371,830, filed on Aug. 11, 1999

(60) Provisional application No. 60/096,186, filed on Aug. 11, 1998.

(51) Int. Cl.[7] ..... F21V 21/30

(52) U.S. Cl. ..... 362/311; 33/244; 362/359; 362/351; 362/353; 362/361; 362/376; 362/509; 362/231; 362/457; 362/458

(58) Field of Search ..... 362/359, 351, 362/353, 361, 311, 376, 509, 231, 457, 458; 206/316.2; 150/166; 116/63 R; 340/931; 33/244; 259/511

(56) References Cited

U.S. PATENT DOCUMENTS

| | | | | |
|---|---|---|---|---|
| 849,409 | * | 4/1907 | Martin | 359/511 |
| 2,849,795 | * | 2/1958 | Vissing | 33/244 |
| 2,889,629 | * | 6/1959 | Darkenwald | 33/244 |
| 5,988,833 | * | 11/1999 | Giese et al. | 362/287 |

* cited by examiner

*Primary Examiner*—Sandra O'Shea
*Assistant Examiner*—Anabel M Ton
(74) *Attorney, Agent, or Firm*—Banner & Witcoff, Ltd.

(57) ABSTRACT

A lens cover for covering the lens of a traffic signal when the signal is not in service. The lens cover is made of a black polyethylene flat tubing which is cut and sealed on one end and has an open end to fit over traffic light lens shields. The lens cover is completely opaque and thus prevents light from the lens passing through. Thus, motorists are not confused with respect to the traffic light being in an operating state. The lens cover also has an observation hole at the bottom which allows one to check the operation of the traffic light from ground level.

1 Claim, 3 Drawing Sheets

TRAFFIC LIGHT LENS COVER

CLAIM OF PRIORITY TO PRIOR APPLICATION

This application is a continuation of U.S. patent application Ser. No. 09/371,830, filed Aug. 11, 1999.

This application claims priority to Provisional Application Ser. No. 60/096,186 filed Aug. 11, 1998.

BACKGROUND OF THE INVENTION

The present invention generally relates to the field of traffic signaling devices and more particularly, is directed to a device for covering the lens of a traffic signal when the signal is not in service.

Due to the evolution of electric traffic signaling devices over the years and the need to maintain orderly and safe traffic flow, the driving public has become conditioned to pay particular attention to traffic lights. Drivers are aware that traffic lights have a predictable and repetitive operation. Even when the light malfunctions, drivers have a tendency to continue to wait at an intersection until the light returns to its normal operation.

Moreover, a traffic light that is out of service can be just as confusing to drivers as one which has malfunctioned. Even when all lamps within view of a motorist are out, the motorist can not conclude with a high degree of certainty that the traffic light is out of service without checking to be sure that all other lamps are out as well. Doing so, however, is usually not practical.

Accordingly, there exists a need in the art to provide a positive indication that a traffic signal is out of service so that motorist are not confused and can readily determine the operational status of the signal.

SUMMARY OF THE PRESENT INVENTION

Accordingly, it is an objective of the present invention to obviate the above-noted shortcomings and disadvantages of inoperative traffic signals.

It is an objective of the present invention to provide a lens cover for inoperative traffic signals which lessens the likelihood that a motorist will be confused about the operational status of the signal.

It is a further objective of the present invention to provide a lens cover for inoperative traffic signals which is easy and convenient to use.

It is a still further objective of the present invention to provide a lens cover for inoperative traffic signals which is economical to make and simple to use.

It is a further objective of the present invention to provide a lens cover for inoperative traffic signals which is more economical than prior art approaches.

It is a still further objective of the present invention to provide a lens cover for inoperative traffic signals which completely prevents any light from the signal being visible to a driver.

BRIEF DESCRIPTION OF THE DRAWINGS

The novel features of the present invention are set out with particularity in the appended claims, but the invention will be understood more fully and clearly from the following detailed description of the invention as set forth in the accompanying drawings in which:

DESCRIPTION OF THE PREFERRED EMBODIMENT

Applicant has invented an opaque lens cover which completely covers a traffic light lens. The cover is nontransparent and is impervious to light so that when the traffic light is out of service the light from any lamps which are lite can not show through and provide confusing directions to motorists. In addition, the cover may also carry a legend visible to the motorist that the light is out of service.

In one embodiment of the invention, the lens cover is made of a black polyethylene flat tubing which is cut and sealed on one end and has an open end which fits over traffic light lens shields. Applicant has found that a thickness of approximately 4 mils provides good performance for polyethylene materials. Other materials may be used as well.

Lens shields are customarily used on traffic lights to shield the sun from the traffic light lens so that light from the lens does not become washed out and thus, not be clearly visible to the motorist. Lens shields typically are circular in construction and project out from the body of the traffic light in a manner which provides a hood for the lens while at the same time allowing an unobstructed view of the lens by motorists.

Figure 1:
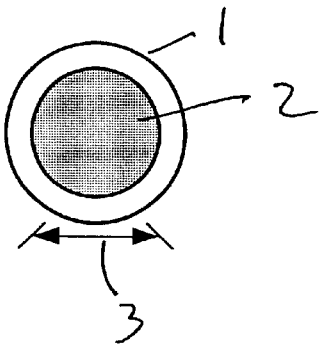
FIG. 1 is front view of a lens shield covering a lens in a conventional traffic light.

FIG. 1 is a front view of a lens shield 1 covering a lens 2. In some constructions, the lens shield completely surrounds lens 2 as illustrated in FIG. 1. In other constructions, the lens shield forms a semi-circle with an open area as indicated by arrowed line 3 in FIG. 1.

Figure 2:
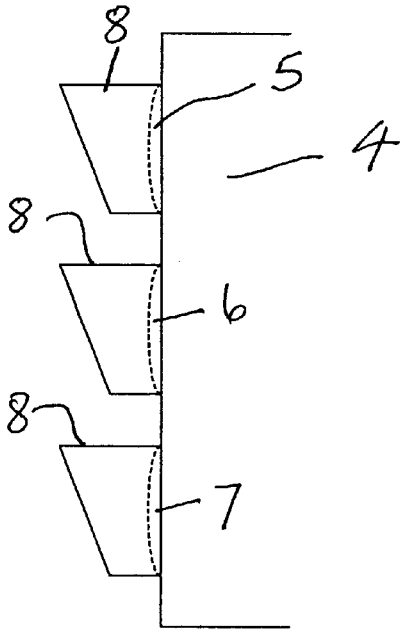
FIG. 2 is side view of the front portion of a conventional traffic light.

FIG. 2 is a side view of the front section of a traffic light 4 having the typical red lens 5, yellow lens 6 and green lens 7. Each lens is protected by respective lens shield 8.

Figure 3:
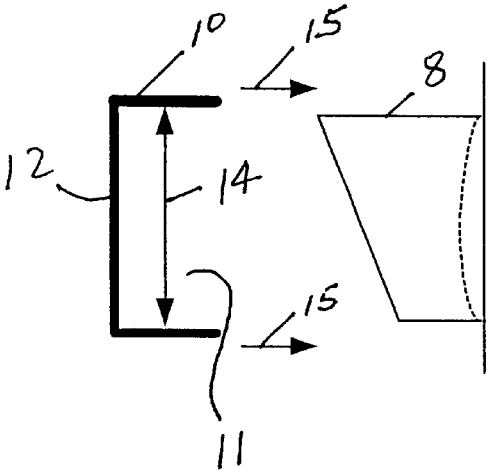
FIG. 3 is a side cross-sectional view of a lens cover according to the present invention illustrating how it is installed over a traffic light lens shield.
Figure 4:
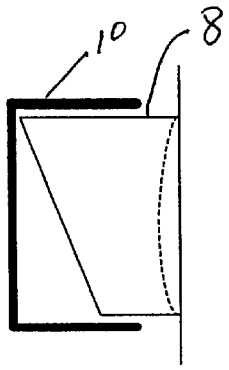
FIG. 4 is a side cross-sectional view of a lens cover according to the present invention shown engaged with a lens shield.

FIG. 3 illustrates in cross-section the installation of a lens cover 10 of Applicant's invention over lens shield 8. As pointed out above, in one embodiment of the invention, lens cover 10 is of tubular construction with an open end 11 and a closed end 12. The cover has a sufficiently large inside diameter 14 so that it can slide over lens shield 8 as indicated by arrows 15. FIG. 4 shows lens cover 10 fully engaged over lens shield 8.

Figure 5:
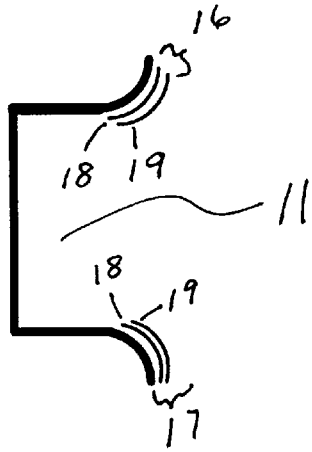
FIG. 5 is a side cross-sectional view of a lens cover according to the present invention illustrating the use of adhesive tape strips.
Figure 6:
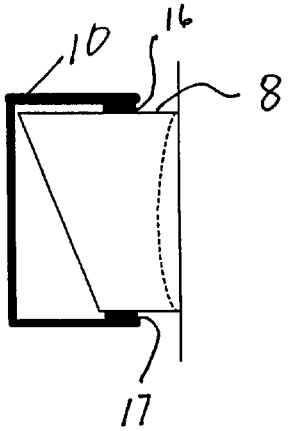
FIG. 6 is a side cross-sectional view of a lens cover according to the present invention shown engaged with a lens shield and being held in position by the tape strips illustrated in FIG. 5.

Len cover 10 can be maintained in position by an adhesive as known in the art for adhering surfaces together. FIG. 5 is a cross-section of lens cover 10 having a pair of double-back tape strips 16 and 17. These tape strips are can be used to hold the cover in place as indicated in FIG. 6. Each tape strip is formed of an adhesive carrier 18 which has adhesive material on both sides. One side of carrier 18 adheres to the inside surface of lens cover 10 while the other side is protected by release liner 19 as known the prior art.

In applying lens cover 10 over lens shield 8, the installer merely needs to flare out open end 11 of the cover as illustrated in FIG. 5 so that it can easily slid over lens shield as shown in FIG. 6. Tape strips 16 and 17 can then be used to hold the cover in place.

Figure 7:
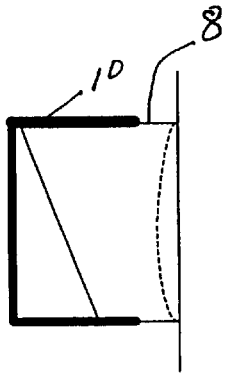
FIG. 7 is a side cross-sectional view of a lens cover according to the present invention shown engaged with a lens shield and being held in position by the interference fit between the two.

The inside diameter of lens cover 10 may also be insignificantly smaller than the outside diameter of lens shield 8 so the lens shield forms an interference fit, thus holding it into position as illustrated in FIG. 7. In this regard, the lens cover may have an elastic characteristic.

Traffic lights generally are designed so that the lens shield and lens form a hinged door on the body of the traffic light housing. They are designed this way so that lights can be easily wired and maintained. The design of Applicant's lens cover permits each door on the traffic light to be opened individually for installation and maintenance without having to remove the lens cover. This is not possible with the make-shift methods of covering inoperative traffic lights as known in the prior art.

The prior art has seen the use of kitchen-type plastic trash bags for covering the entire traffic light when it is out of service. Each time there is work to be done on the light, the bag has to be removed and if the work is not completed and the light put into service, the bag has to be replaced over the light. Doing so, is of course, a time consuming endeavors. Moreover, plastic trash bags were never designed for this purpose and are subject to ripping which requires their replacement. Applicant's invention avoids this problem as the lens cover can be installed without interfering with the ability to maintain the traffic light.

Figure 8:
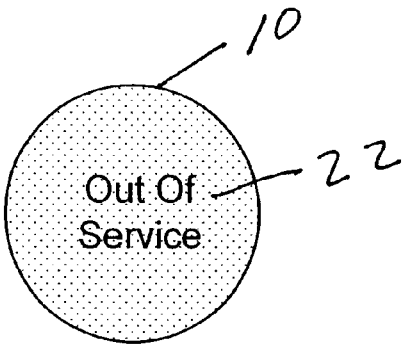
FIG. 8 is an end view of a lens cover according to the resent invention illustrating the presence of a legend for display to motorists.
Figure 9:
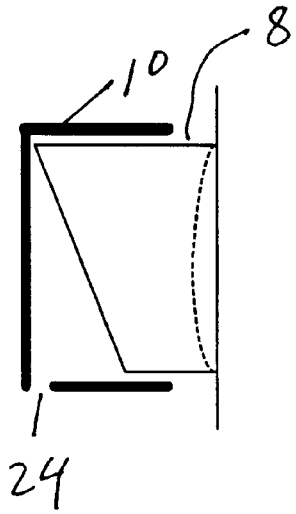
FIG. 9 a side cross-sectional view of a lens cover according to the present invention illustrating the presence of an observation hole for checking the operation of the light.

In another embodiment of the present invention, a legend can be formed on the end of the lens cover advising motorists that the traffic light is out of service. FIG. 8 is an end view of lens cover 10 illustrating such a legend 22. The legend can merely be printed on the end of the cover. A flourescent or highly reflective print color can be used in order to make the legend more visible during periods of darkness. Alternatively, the legend can be formed as a cut out through which light from the lens shines in order to illuminated the legend. The utility of this approach is limited if the traffic light is completely inoperative.

In another embodiment of the present invention, lens cover 10 is provide with an observation hole 24 so the light can be visually checked for operation by someone standing directly below the traffic light. The location of hole 24 is such that it can not be readily seen by on coming motorists. It does, however, provide a convenient way to check the operation of the light from the ground level.

Figure 10:
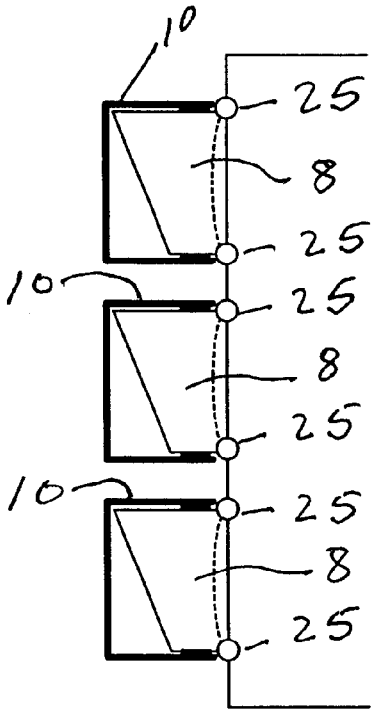
FIG. 10 is side view of the front portion of a conventional traffic light illustrating the use of a lens cover according to the present invention.

FIG. 10 illustrates the use of Applicant's lens cover over the red, yellow and green lights of a conventional traffic light. Also illustrated are hinges 25 which allow the lens and lens shield assembly to swing open for installation and maintenance as is known in the prior art.

It should be obvious from the above-discussed description that numerous other variations and modifications of the present invention are possible, and such will readily occur to those skilled in the art. Accordingly, the scope of this invention is not to be limited to the embodiment disclosed.

I claim:

1. A lens cover for a traffic light lens, said lens cover comprising:

a tube having a closed end and an open end, wherein said open end is adapted to fit over the lens shield of said traffic light and wherein said tube is opaque and prevents light from said traffic light lens from passing through.

* * * * *